US005603179A

United States Patent [19]

Adams

[11] Patent Number: 5,603,179

[45] Date of Patent: Feb. 18, 1997

[54] SAFETY TRIGGER

[76] Inventor: Heiko B. Adams, 111 W. Main St., apt. 2, Morehead, Ky. 40351

[21] Appl. No.: 540,779

[22] Filed: Oct. 11, 1995

[51] Int. Cl.[6] ..... F41A 17/26

[52] U.S. Cl. ..... 42/70.08; 42/70.11; 42/70.06

[58] Field of Search ..... 42/70.11, 70.06, 42/70.09, 70.05, 70.01

[56] References Cited

U.S. PATENT DOCUMENTS

| | | | |
|---|---|---|---|
| 4,467,545 | 8/1984 | Shaw, Jr. | 42/70.08 |
| 4,970,819 | 11/1990 | Mayhak | 42/70.01 |
| 5,062,232 | 11/1991 | Eppler | 42/70.11 |
| 5,459,957 | 10/1995 | Winer | 42/70.11 |
| 5,502,915 | 4/1996 | Mendelsohn et al. | 42/70.11 |

FOREIGN PATENT DOCUMENTS

| | | | |
|---|---|---|---|
| 3446019 | 6/1986 | Germany | 42/70.11 |

*Primary Examiner*—Stephen M. Johnson
*Attorney, Agent, or Firm*—Michael I. Kroll

[57] ABSTRACT

A safety mechanism for a firearm consisting of a specialized scanning mechanism built into the firearm's trigger. The scanner is programmed to read the unique fingerprints of a given individual. The device is also capable of holding the programmed print information for more than one person, so that multiple people would he able to use the firearm. However, usage is limited to only those persons whose hand prints have been prestored in the scanner. The scanner mechanism is connected to the firearm's safety lock. The safety is prevented from being released without proper authorization from the scanner. When a person grips the weapon and places his finger on the trigger, the pressure of the finger on the trigger activates the scanner, and the scanner reads the fingerprint to determine if the scanned fingerprint matches one of the pre-stored fingerprint images. If the individual is an authorized user, the scanner transmits a signal to the safety, releasing this device and activating the firearm for use.

5 Claims, 3 Drawing Sheets

SAFETY TRIGGER

BACKGROUND OF THE INVENTION

1. Field of the Invention

The instant invention relates generally to hand operated devices, and, more specifically it relates to such devices which scan the fingerprint of the user, and only allow use of the devices if the image scanned matches an internally stored image.

2. Description of the Background Art

Various devices have been provided in the prior art which allow their use only if certain preliminary conditions have been satisfied. For example, U.S. Pat. No. 4,105,885 to Orenstein is illustrative of such prior art. While these units may be suitable for the particular purpose to which they address, they would not be as suitable for the purposes of the present invention as heretofore described.

Orenstein, Henry

HAND OPERATED INSTRUMENTS HAVING NON-MAGNETIC SAFETY SWITCH

U.S. Pat. No. 4,105,885

Operator controlled devices in the form of hand operated instruments in which a ring worn by an operator is configured to be insertable into a recess in a hand holdable portion of the instrument. The recess includes a fixed contact configuration that is engageable by a non-magnetic bridging contactor on an outer peripheral face of the ring, so that the instrument becomes operational when the contactor is inserted into the recess and engages the fixed contact configuration.

SUMMARY OF THE INVENTION

The instant invention, The Safety Trigger, is a security device to be used for preventing the unauthorized use of a firearm.

The device consists of a specialized scanning mechanism built into the firearm's trigger which provides input to a central processing unit within the grip of the gun. The scanning mechanism is programmed to read the unique fingerprints of a given individual. The central processing unit holds a fingerprint recognition program of the type well known in the art. The central processing unit also holds programmed fingerprint information for more than one person, so that multiple people would he able to use the firearm. However, usage is limited to only those persons whose fingerprints have been stored in the central processing unit.

The scanner mechanism is connected to the firearm's safety lock. The safety is prevented from being released without proper authorization from the scanner. When a person grips the weapon and places his finger on the trigger, the pressure of the finger on the trigger activates the scanner, and the scanner reads the fingerprint to determine if the scanned fingerprint image matches one of the pre-stored fingerprint images. Assuming the individual is an authorized user, the scanner transmits a signal to the safety, releasing this device and activating the firearm for use.

The safety trigger device comprises a sensor trigger with a pressure sensitive membrane. The sensor trigger has a plurality of fingerprint recognition sensors on the front finger-contact surface of the trigger. A scanner is optically connected to the finger-contact surface of the sensor trigger, and is activated by pressure on the pressure sensitive membrane of the sensor trigger. An internal safety mechanism is mechanically connected to the scanner and engagingly coupled to the hammer of the firearm. A battery-powered central processing unit within the interior of the pistol grip is electrically connected to the scanner and receives the scanned fingerprint from the scanner. After determining whether or not the scanned fingerprint matches one of the stored fingerprints in its memory, the central processing unit transmits go/no information to the scanner which then either activates or deactivates the internal safety mechanism. If the internal safety mechanism is activated, the gun is allowed to be fired by the user. Otherwise, the hammer of the pistol is locked and the pistol cannot be fired. The central processing unit has an on/off switch for activating and deactivating the central processing unit. A program port is electrically connected to the central processing unit for the reception of a program card with the fingerprint information of the prospective authorized users contained thereon.

The primary benefit The Safety Trigger offers is safety. As the debate over gun control continues to rage, one area often mentioned is accidental firings. The use of the Safety Trigger would serve as an effective means of rendering any firearm safer by reducing the possibility of the firearm going off accidentally. The product would serve to avoid such mishaps as children finding an unsecured weapon and accidentally shooting themselves or someone else as well as the occasional instance of a gun owner inadvertently discharging a weapon and causing death or injury.

In a broader sense, The Safety Trigger delivers to the consumer the benefit of peace of mind. It is, in essence, an "insurance" type of product. Certainly, the gun owner hopes that no such accidents will ever occur and may very well already he taking other measures to reduce the possibility of a mishap (such as keeping the firearms in a locked cabinet when not in use, making sure that the weapons are always unloaded when stored and keeping ammunition in a separate location, attaching locks to the triggers, etc.). However, The Safety Trigger will serve as one additional measure of safety, adding an extra sense of peace of mind to the gun owner.

It is anticipated that the demand for the Safety Trigger will be based primarily on its voluntary application by individual gun owners to their weapons as a means of safeguarding the firearms against accidental discharge or intentional use by an authorized individual. These are strong motivation factors for the conscientious, law-abiding gun owner who wants to assure that his firearms will not be misused with potentially tragic consequences.

It is contemplated that this "Safety Trigger" design will be used in other applications as well. Such other applications include door locks of all types, with the elimination of the need for "Keys" of all sorts.

The Safety Trigger is a new application of existing technology. It does not require any unique processed for its manufacture. The overall design, assembly, and mechanisms are essentially the same as they are for similar scanning products already being produced.

Accordingly, the above problems and difficulties are obviated by the present invention which provides for a safety trigger for a firearm which prevents unauthorized usage of the firearm. Unlike prior art devices, magnetized and other types of rings for the trigger finger, which tend to become misplaced, are not required. One ordinarily does not misplace one's fingerprint. Hence the major advantage of the instant invention over prior art devices can be readily seen.

Thus, a primary object of the present invention is to provide a safety trigger for firearms that will overcome the shortcomings of the background art devices.

Another object is to provide a safety mechanism for a firearm which does not require an activating device which can easily be misplaced and consequently may not be readily available when needed the most.

An additional object is to provide a safety device which can be programmed to allow use by a wide group of authorized users, and will not allow the use thereof by any unauthorized user.

A further object is to provide a protective mechanism for a firearm that is simple and easy to use.

A still further object is to provide a safety trigger for a firearm that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a diagrammatic perspective view with parts broken away of a pistol equipped with a safety trigger mechanism in accordance with the instant invention;

FIG. 1*a* is a diagrammatic perspective view of the safety trigger with the trigger finger of the right hand of the user placed thereon;

FIG. 1*b* is a cross sectional view taken in the direction of line 1—1 of FIG. 1 showing the scanner mechanism of the safety trigger in greater detail;

DETAILED DESCRIPTION OF THE PREFERRED EMBODIMENTS

Figures 1, 1A, 1B:
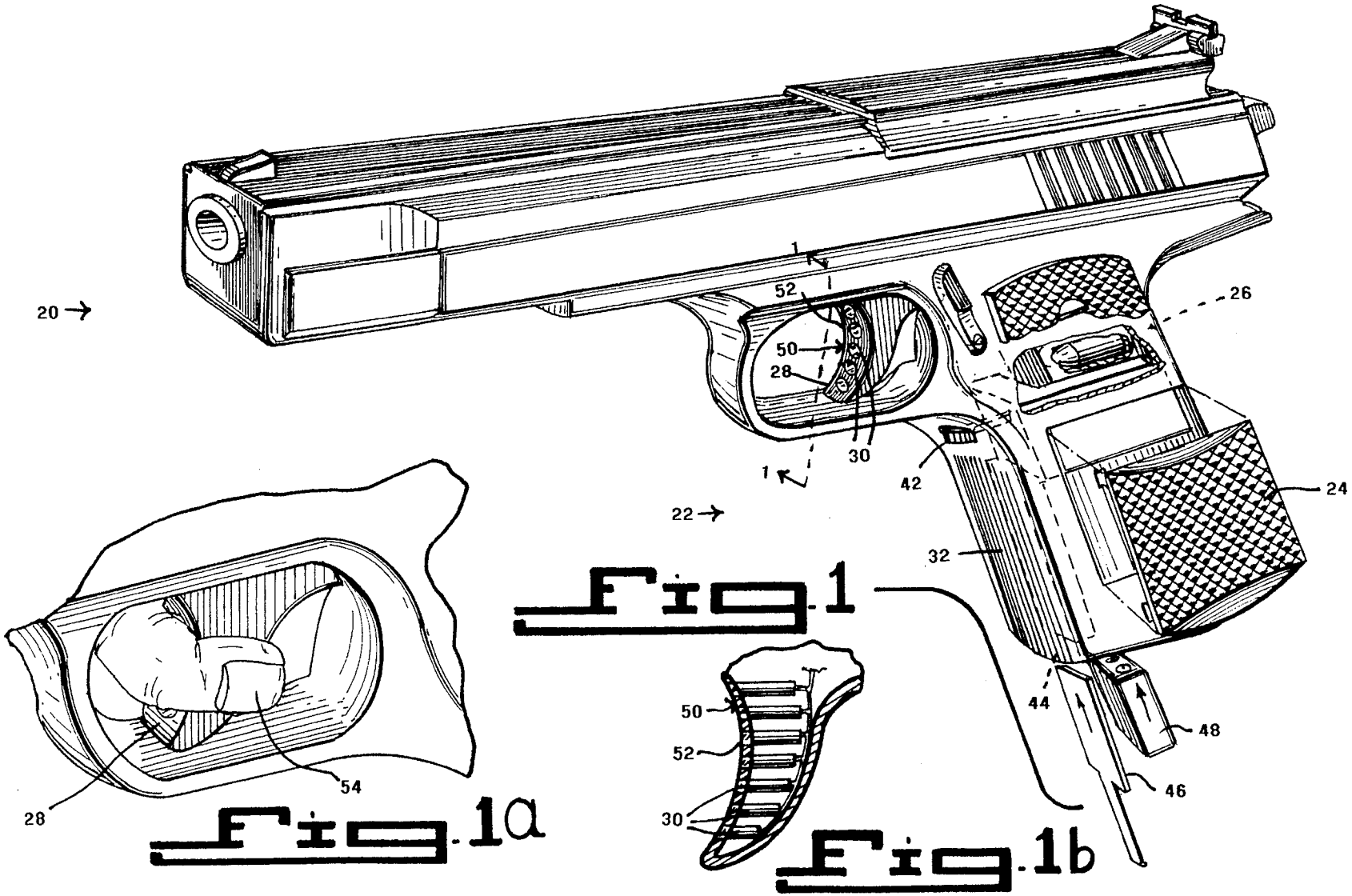

Turning now descriptively to the drawings, in which similar reference characters denote similar elements throughout the several views, FIG. 1 illustrates a pistol, generally shown as 20, equipped with the safety trigger mechanism of the instant invention generally shown as 22.

Figure 6:
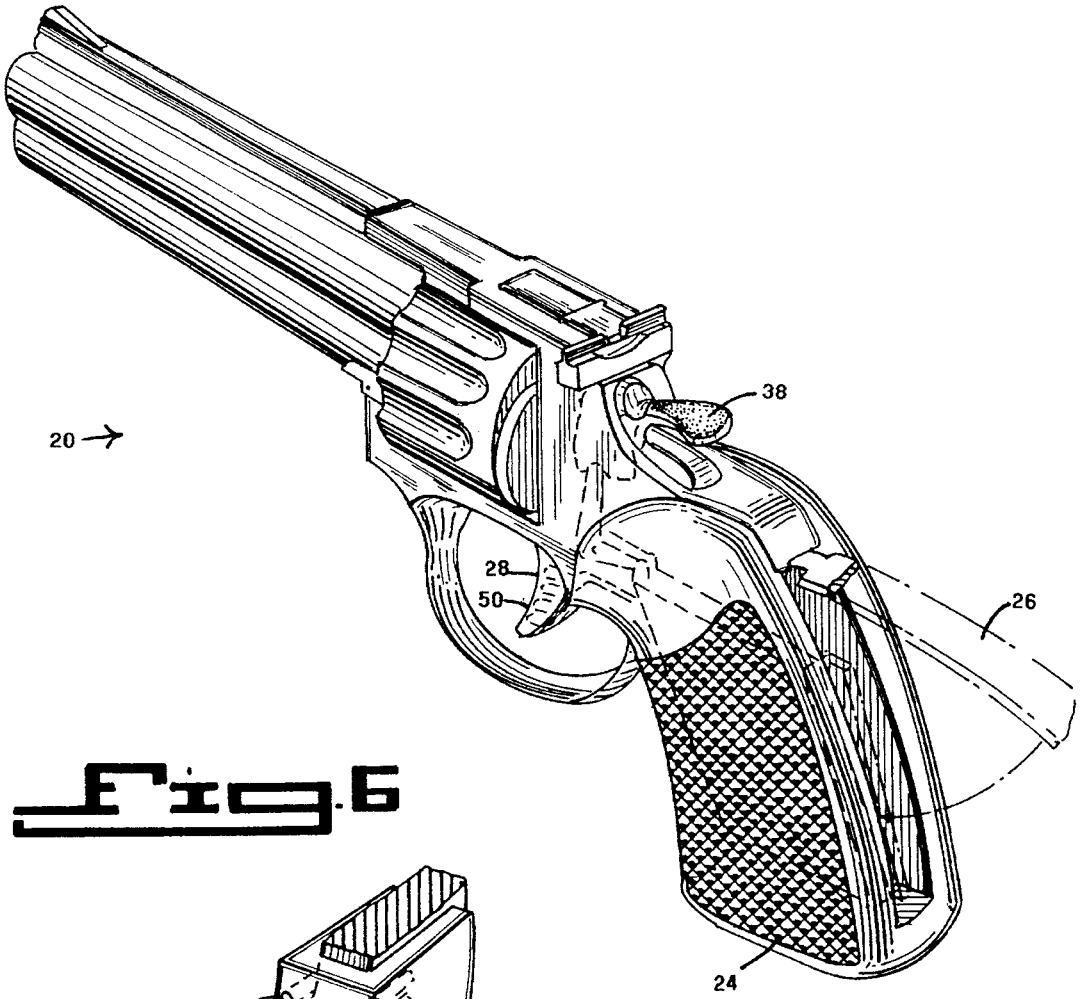
FIG. 6 is a diagrammatic perspective view of a pistol equipped with a safety trigger mechanism in accordance with the instant invention, showing the rear door for the placement of the scanning mechanism therein.

As shown in FIG. 6, the grip 24 of a firearm such as pistol 20 has an outer access door 26 removably attached to the pistol grip 24 for accessing the interior of the pistol grip. As shown in FIG. 1, the instant invention comprises a sensor trigger 28 having a front surface, two side surfaces, and a rear surface. The sensor trigger 28 has a plurality of fingerprint recognition sensors 30 on its front surface. A scanner 34 within the cavity of the pistol grip 24 is optically connected to the numerical indicator 32 of the sensor trigger 28, and is activated by pressure on the sensor trigger 28. An internal safety mechanism 36 is optically connected to the scanner 34 and is engagingly coupled to the hammer 38 of the pistol 20. A central processing unit 40 within the interior of the pistol grip 24 receives the scanned fingerprint images from the scanner. The central processing unit 40 is activated when an on/off switch 42 on the exterior surface of the pistol is turned to the "ON" position. A program port 44 is electrically connected to the central processing unit 40. A program card 46 with fingerprint information for each of the authorized users contained on it is inserted in the program port 44 and the fingerprint information is uploaded from the program card 46 into the memory of the central processing unit 40.

As shown in FIG. 1, a battery unit 48 is electrically connected to the central processing unit 40 for powering the central processing unit 40.

In use, the gun operator would turn on the on/off switch 42, and press on the trigger 28. In one embodiment, a sensing mechanism 50 such as pressure sensitive membrane 52 on the trigger 28 would sense the pressure of the user's finger 54, and the scanner 34 would be activated thereby. The scanner 34 would read the fingerprint of the user, and transmit the fingerprint information to the central processing unit 40. The central processing unit 40 is preloaded with a fingerprint processing and recognition program of a type which is well known to those who are skilled in the art. Additionally there is a program card 46 with fingerprint information contained thereon. This program compares the fingerprint image from the scanner 34 with the prestored fingerprints in its database of authorized fingerprints. If the scanned fingerprint matches one of the prestored fingerprint images in the database, a "match" signal is generated and transmitted back to the scanning mechanism. As a result of the "match" signal, the scanning mechanism disengages the internal safety mechanism 36 thus allowing the hammer 38 to cock, and the pistol 20 to fire. If the scanned fingerprint does not match one of the fingerprint images in the database, a "no match" signal is generated and transmitted back to the scanning mechanism. As a result of the "no match" signal, the scanning mechanism engages the internal safety mechanism 36 thus not allowing the hammer 38 to cock, and the pistol 20 consequently will not fire.

In an alternate embodiment of the instant invention, upon depressing the sensor trigger 28, the trigger 28 would only partially depress, which movement of the trigger 28 would activate the scanner 34 which would then scan the user's fingerprint as before. And again, the scanner 34 would read the fingerprint of the user and compare it with its database of authorized fingerprints.

FIG. 1*a* shows the trigger 28 of the safety trigger with a user's trigger finger 54 placed thereon.

FIG. 1*b* shows the fingerprint recognition sensors 30 of the scanner mechanism of the safety trigger in greater detail.

Figure 2:
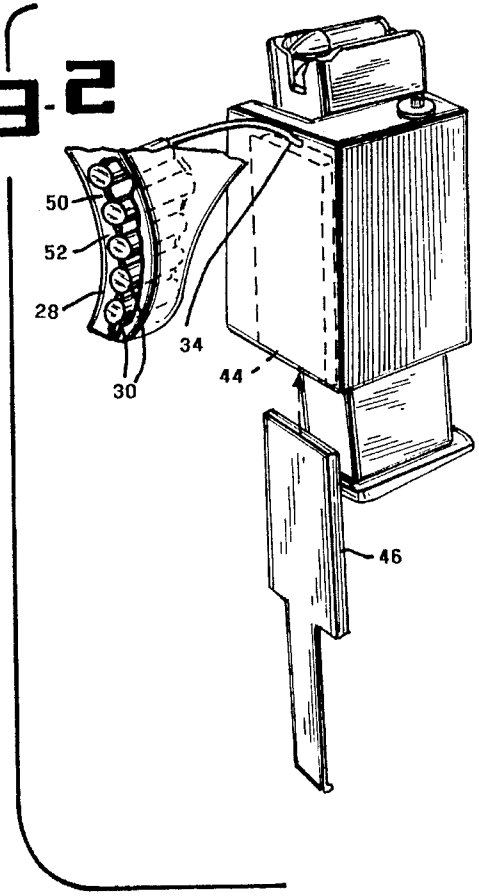
FIG. 2 is an enlarged view of a portion of the trigger mechanism in the instant invention.

FIG. 2 is an enlarged view of a portion of the trigger mechanism in the instant invention. The program card 46 containing user fingerprint images is being inserted into the program port 44.

Figure 3:
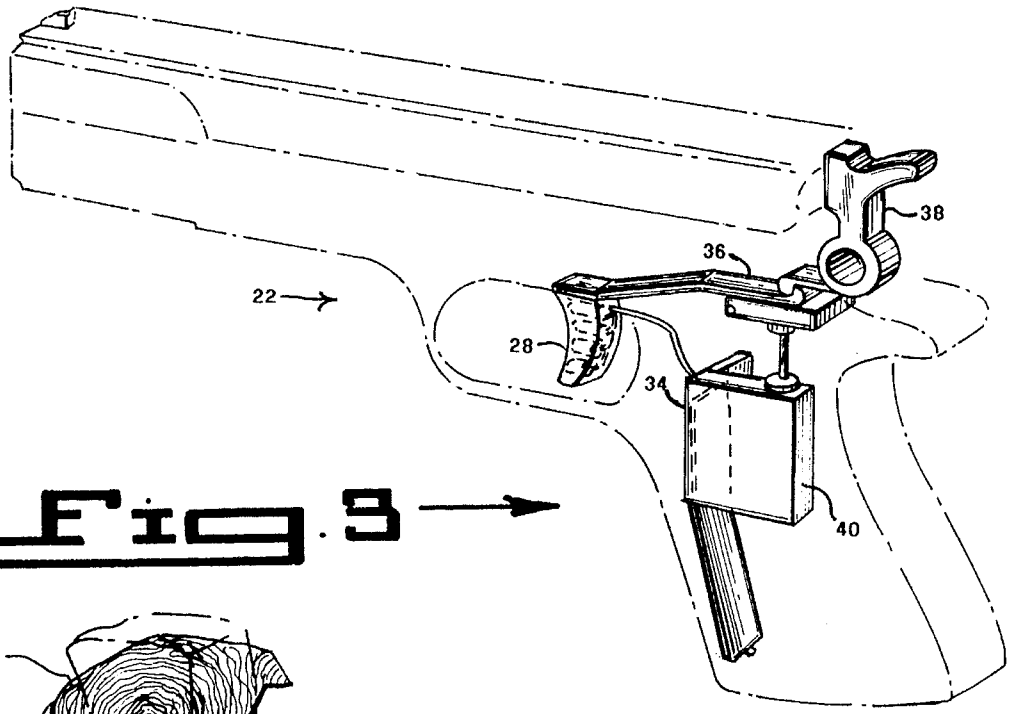
FIG. 3 is a diagrammatic perspective view with parts broken away of a pistol equipped with a safety trigger mechanism in accordance with the instant invention.

FIG. 3 shows the safety trigger mechanism 22 of the instant invention in greater detail.

Figure 4:
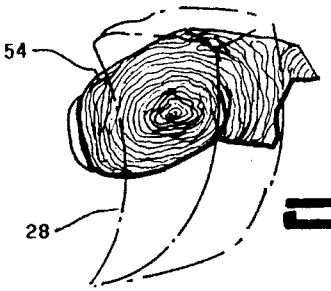
FIG. 4 is a diagrammatic perspective view of the safety trigger with the trigger finger of the right hand of the user placed thereon and showing the fingerprint of the user.

FIG. 4 shows the safety trigger with the trigger finger 54 of the right hand of the user placed thereon and showing the fingerprint of the user.

Figure 5:
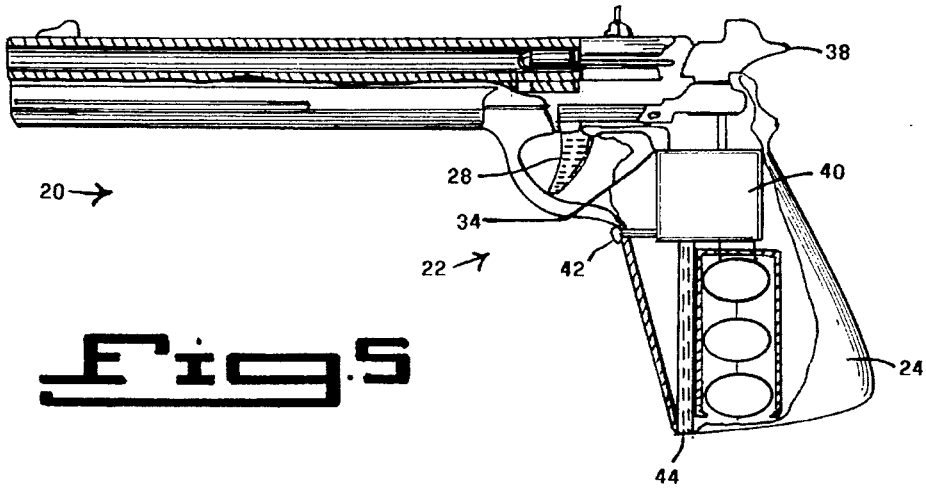
FIG. 5 is a diagrammatic side elevational view of the instant invention with parts broken away, showing a more detailed view of the interior mechanism.

FIG. 5 is a diagrammatic side elevational view of the instant invention with parts broken away, showing a more detailed view of the interior mechanism.

Figure 7:
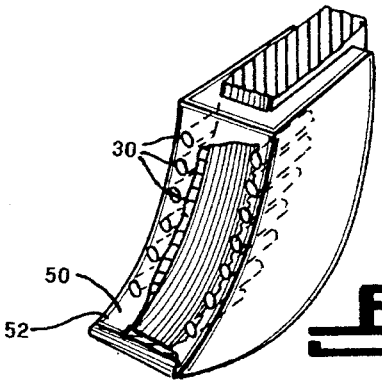
FIG. 7 is a diagrammatic perspective enlarged view of the sensor trigger showing the optical scanner ports in greater detail.

FIG. 6 is a diagrammatic perspective view of a pistol equipped with a safety trigger mechanism in accordance with the instant invention, showing the rear door for the placement of the scanning mechanism thereon;

FIG. 7 is a greatly enlarged diagrammatic perspective view of the sensor trigger showing the optical scanner ports thereof in greater detail.

LIST OF REFERENCE NUMBERS

20 pistol
22 safety trigger mechanism
24 pistol grip
26 access door
28 sensor trigger
30 fingerprint recognition sensor
32 front surface of pistol grip
34 scanner
36 internal safety mechanism
38 hammer of the pistol
40 central processing unit
42 on/off switch
44 program port
46 program card
48 battery unit
50 sensing mechanism
52 pressure sensitive membrane
54 user's trigger finger It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety trigger device for a hand-held firearm, said firearm having a hammer, a firing pin, and a pistol grip having a front surface, a rear surface, and two side surfaces, said surfaces defining a cavity within the pistol grip, said pistol grip further having an outer access door for accessing the cavity within said pistol grip, said device comprising:

(a) a sensor trigger having a front surface and two side surfaces, and a rear surface, said sensor trigger having a fingerprint recognition sensor on the front surface thereof;

(b) a scanner optically connected to said front surface of said sensor trigger, and activated by pressure on said sensor trigger;

(c) an internal safety mechanism mechanically connected to the scanner and engagingly coupled to the hammer of said firearm;

(d) a central processing unit within said cavity within said pistol grip electrically connected to said scanner, said central processing unit holding a fingerprint recognition program;

(e) a program card with fingerprint information contained thereon, (f) a program port electrically connected to said central processing unit for the reception of said program card.

2. The safety trigger device as recited in claim 1, wherein said sensor trigger has a pressure sensitive membrane.

3. The safety trigger device as recited in claim 1, wherein said safety trigger device further comprises a battery unit electrically connected to said central processing unit for powering the same.

4. The safety trigger device as recited in claim 1, wherein said outer access door is attached to rear surface of said pistol grip, whereby access is provided to interior of said pistol grip.

5. The safety trigger device as recited in claim 1, wherein said central processing unit has an on/off switch and means for the reception of battery power.

* * * * *